9/29/87 OR 4,696,240

United States Patent [19]

Maxeiner

[11] Patent Number: 4,696,240

[45] Date of Patent: Sep. 29, 1987

[54] SAFETY CONTAINER

[75] Inventor: Heinz Maxeiner, Neu-Isenburg, Fed. Rep. of Germany

[73] Assignee: Bode-Panzer, Fed. Rep. of Germany

[21] Appl. No.: 819,394

[22] Filed: Jan. 16, 1986

[30] Foreign Application Priority Data

Mar. 1, 1985 [DE] Fed. Rep. of Germany ..... 3507214

[51] Int. Cl.[4] ..... E04B 2/02

[52] U.S. Cl. ..... 109/82; 29/455 LM; 52/807; 228/165; 220/445

[58] Field of Search ..... 109/49.5, 65, 80, 82, 109/83, 84, 85, 78; 220/DIG. 29, 445; 75/128 R; 29/455; 52/807; 228/165

[56] References Cited

U.S. PATENT DOCUMENTS

| | | | |
|---|---|---|---|
| 146,047 | 12/1873 | Crump | 109/84 |
| 2,055,339 | 9/1936 | Dalton | 52/807 |
| 2,352,754 | 7/1944 | Anderson | 220/DIG. 29 |
| 3,115,447 | 12/1963 | Stengel | 29/455 |
| 3,439,885 | 4/1969 | Sackleh | 29/455 |
| 3,598,574 | 8/1971 | Tetsuro | 75/128 R |

FOREIGN PATENT DOCUMENTS

| | | | |
|---|---|---|---|
| 259352 | 9/1911 | Fed. Rep. of Germany | 109/65 |
| 8220470 | 7/1982 | Fed. Rep. of Germany . | |
| 2367898 | 5/1980 | France | 109/85 |
| 1600236 | 10/1981 | United Kingdom | 109/49.5 |

OTHER PUBLICATIONS

In Re Roberts, 1940, CD 54.

*Primary Examiner*—James L. Ridgill, Jr.
*Attorney, Agent, or Firm*—Allegretti, Newitt, Witcoff & McAndrews, Ltd.

[57] ABSTRACT

A safety container, for example a strong box or safe, having rigid walls which provide safety against drilling and cutting with a torch. The wall has an external layer of heat-resistant chrome-nickel steel, and an internal wall of non-alloyed steel which are welded to a series of parallel closely-spaced ribs extending the length of the wall. The elongated pockets formed between the opposed metal layers and adjacent ribs are filled with bars of highly conductive aluminum having bodies of corundum embedded therein.

5 Claims, 2 Drawing Figures

SAFETY CONTAINER

The invention relates to a safety container and particularly though not exclusively to a strong box or safe.

East German Pat. No. 8220470 discloses a drill-resisting plate for insertion between two steel concrete walls which in conjunction with the said drill-resisting plate form the wall of the safety container. The two steel-concrete walls form the means for ensuring the rigidity of the wall, while the drill resisting plates form means for ensuring safety against drilling. The drill-resisting plate is neither suitable nor intended for the purpose of rendering the wall rigid. The drill-resisting plate consists of two layers of metal between which is provided a close-meshed grid of crosspieces which is welded at spaced-apart points onto one layer of metal and spot-welded at spaced-apart points, and with interposed tie plates, onto the other layer of metal. The layers of metal, although connected to the "web grid", do not combine therewith to form a rigid profile. Neither does this known wall for a safety container have any means for protection against burning or cutting with a torch. The compartments of the web grid merely contain balls or roll pins and lubricant in alternation, designed simply to prevent drilling. This known wall for a safety container is thus heavy, owing to the concrete walls, and is therefore unsuitable for small containers or simple structures. The steel concrete walls can be cut with modern drilling tools, and the drill-resisting plate can be effectively attacked with a cutting torch.

The purpose of the invention is to provide a safety container of the type described which is rigid without the excessive weight of concrete layers which provides sufficient protection against torch cutting and mechanical drilling.

The invention provides a safety container comprising: at least one wall which has two layers of metal spaced apart and interconnected by spaced ribs secured over substantially their entire length with the layers of metal, and bars of material in the spaces between the ribs, having a high thermal conductivity, and in which bodies of drill-resisting hardness are embedded.

An important feature of the invention is that the container is lightweight, that is the fundamental abandonment of the hitherto exclusive of steel concrete, which renders either the safety container or the wall pieces required for it heavy and thus difficult to transport and mount. In place thereof the wall of the safety container according to the invention consists of two metal plates secured together with interposed ribs to provide a firm-sectioned unit of the desired rigidity. As a protection against cutting with a high temperature torch, the outer layer of metal is made of a highly heat-resistant material, e.g., a suitable chrome-nickel steel alloy. To prevent drilling, drill-resistant bars or rods are privided in the pockets or channels formed between the ribs. The bars advantageously fill the channels in their entirety and consist of a material of high thermal conductivity which at the same time contains drill-resistant bodies. If an attempt at drilling exposes an internal bar of this kind, further drilling is rendered more difficult by the drill-resisting bodies embedded in the material of the bars. Burning through the metal is likewise rendered dificult because the heat is rapidly carried off by the long heat-conductive bars. These bars should extend over sufficient distance to render the dissipation of heat effective and also prevent the strips from being extracted from between the layers comprising the wall. The construction of the connecting parts between the outer layers of metal as parallel ribs or crosspieces in contradistinction to the known type of "web grid" is therefore particularly advantageous.

An example of suitable burn-resistant material for the outer layer of metal is a chrome nickel steel preferably having a chromium content of at least 17% and a nickel content of at least 8.5%. A chromium content of 17–20% and a nickel contenc of 8.5–10% are of particular advantage.

The bars of material of good thermal conductivity preferably consist of aluminum and the drill-resisting bodies embedded therein corundum. ($Al_2O_3$). Corundum is extremely hard.

A preferred embodiment of the invention will now be described with reference to the accompanying drawing, wherein.

Figure 2:
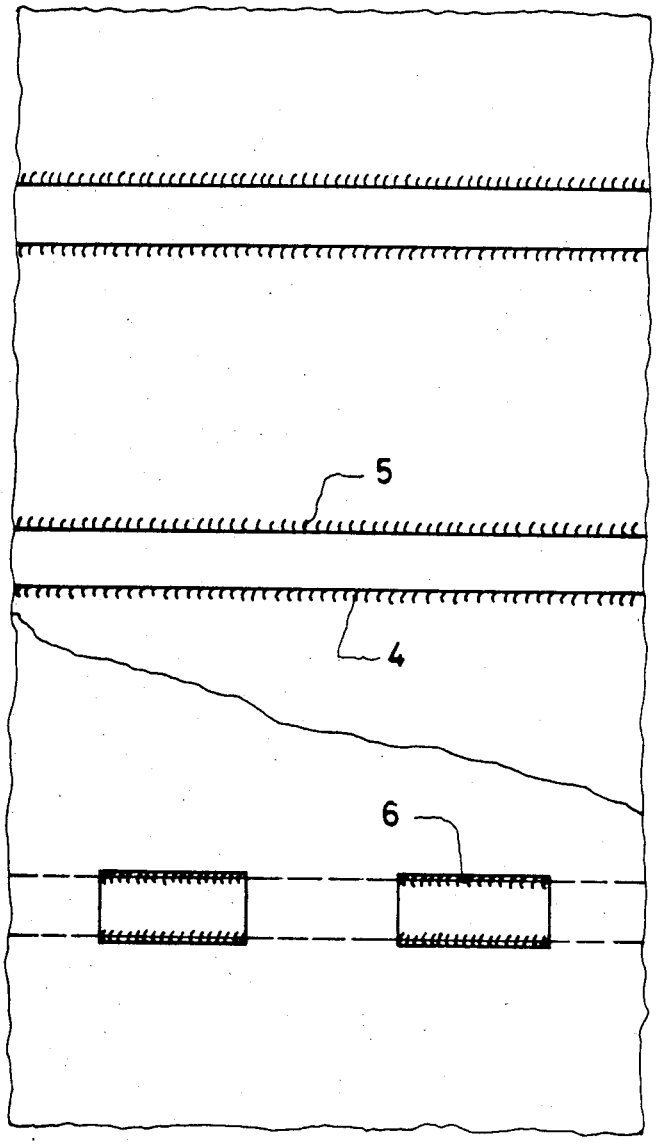
FIG. 2 is a longitudinal section showing the welds securing the ribs to the container wall layers.
Figure 1:
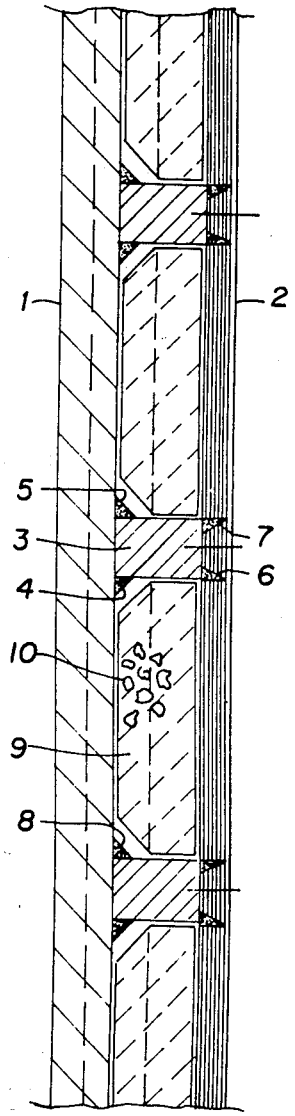
FIG. 1 is a partial cross-section through a wall of safety container according to the invention.

The wall of the safety container is built up from an outer layer of metal 1 and an inner layer of metal 2 between which spaced parallel ribs 3 extend over practically the entire length of the wall. The ribs 3 are selded over their entire length to the outer layer of metal 1 by narrow welding seams 4 and 5. The ribs are connected to the inner layer 2 metal by welds 6 in the area spaced grooves 7 in the surface of metal 2. These grooves 7 with the corresponding welds 6 are situated so coloe together along the ribs 3 that the result is practically a linear weld. The layers of metal 1 and 2 and the ribs 3 thus combine to form an extremely rigid and firm section.

These spaces between layers of metal 1 and 2, and in between the ribs 3, form elongate channels or pockets 8 in which thick bars 9 are disposes. The bars 9 extend over practically the entire length of the pockets 8 and also over practically the entire length of a wall of the safety container. The bars 9 are made of aluminum in which drill-resisting bodies 10 of corundum are tightly embedded.

The layer of metal 1 consists of chrome nickel steel with a chromium content of about 18% and a nickel content of about 9%. The ribs 3 and the layer of metal 2 consist of unalloyed steel.

In the event of an attack on the safety container wall described, the high strength and rigidity of the cross section of the unit provides protection against impact and pressure. If a cutting torch is used, protection is provided by the heat resisting metal selected for the outer layer of the wall. If an attempt to drill through the wall with a crown drill, it is possible that a righ-shaped hole can be made in the layer of metal 1, but because of the internal welding seams 4 and 5, the nature and arrangement of the internal structure is not discernible from the outside, so that a disc of material separated with a crown drill will very probably get caught on one, two or even more of the ribs 3, further separation of the material being thereby rendered impossible. Even when a disc separated from the layer of metal 1 with a crown drill can be worked loose between two ribs 3 and thus removed, further dirlling is limpeded by the drill-resisting bodies 10 embedded in the strips 9. The heating of the bars 9 with a cutting torch is made extremely difficult the considerable thermal conductivity and the length of the bars 9.

What is claimed:

1. A lightweight safety container comprising at least one rigid wall having an outer layer of a metal alloy characterized by resistance to the heat of a cutting torch, an inner metal layer, said layers being interconnected in spaced relation by a series of spaced parallel ribs to form elongated channels between adjacent ribs, said ribs extending substantially the entire length of said wall, said ribs being welded to said layers along their entire length by practically linear welds, said welds projecting into grooves in the face of one of said layers, bars of high thermal conductive metal disposed within and extending along the length of said channels, and bodies of drill resistant hardness embedded in said bars.

2. The container of claim 1 wherein said outer layer metal alloy is chrome nickel steel.

3. The container of claim 2 in which said thermal conductive metal is aluminum and said drill resistant bodies are corundum.

4. The container of claim 2 in which the chrome nickel steel contains at least 17% chromium and at least 8.5% nickel.

5. The container of claim 2 in which the chrome nickel steel contains 17%–20% chromium and 8.5–10% nickel.

* * * * *